United States Patent [19]

Mooney et al.

[11] Patent Number: 4,869,612

[45] Date of Patent: Sep. 26, 1989

[54] LIQUID APPLICATOR ESPECIALLY SUITABLE FOR APPLICATION OF SUNTAN LOTION

[76] Inventors: Charles W. Mooney, 7521 Caesar Ct., Apt. B, Lake Worth, Fla. 33467; Brian J. Bonner, 322 N. Federal Hwy., Deerfield Beach, Fla. 33441

[21] Appl. No.: 806,681

[22] Filed: Dec. 9, 1985

[51] Int. Cl.[4] ..... A45D 33/00

[52] U.S. Cl. ..... 401/130; 401/118; 220/238; 132/317; 132/320

[58] Field of Search ..... 401/17, 18, 23, 118, 401/127, 122, 130, 120; 15/210 R, 244 R; 132/88.5, 88.7, 85, DIG. 3; 215/359, 357, 358; 220/237–238

[56] References Cited

U.S. PATENT DOCUMENTS

| | | | |
|---|---|---|---|
| D. 246,804 | 12/1977 | Kesler | D28/7 |
| D. 284,421 | 7/1986 | Siris | D3/30.1 |
| 634,606 | 10/1899 | Beeching | 401/130 |
| 663,248 | 12/1900 | Sturgis . | |
| 879,706 | 2/1908 | Watson . | |
| 1,278,225 | 9/1918 | Schamberg . | |
| 2,218,738 | 10/1940 | Boysen | 132/DIG. 3 X |
| 2,742,660 | 4/1956 | Van Esley . | |
| 2,860,359 | 11/1958 | James | 401/207 X |
| 3,103,032 | 9/1963 | Brenne | 401/18 X |
| 3,128,493 | 4/1964 | Paul | 401/207 X |
| 3,554,657 | 1/1971 | Aston | 401/122 |
| 4,077,725 | 3/1978 | Slautterback | 401/17 |
| 4,078,865 | 3/1978 | Moser | 401/23 |
| 4,128,350 | 12/1978 | Gamache | 401/208 |
| 4,148,318 | 4/1979 | Meyer | 128/269 |
| 4,165,942 | 8/1979 | Johansson | 401/132 |
| 4,171,171 | 10/1979 | Jones | 401/150 |
| 4,183,328 | 1/1980 | Lawrence | 132/112 X |
| 4,396,028 | 8/1983 | Waggoner | 132/88.7 |
| 4,433,928 | 2/1984 | Kingsford | 401/122 |
| 4,446,880 | 5/1984 | Gueret et al. | 132/88.5 |
| 4,483,636 | 11/1984 | Meyer | 401/266 |
| 4,571,106 | 2/1986 | Scuderi . | |

OTHER PUBLICATIONS

*New Sunscreen,* Financial Supplemental to The Fort Lauderdale News, Oct. 28, 1985.

*Primary Examiner*—Richard J. Apley
*Assistant Examiner*—R. Bahr
*Attorney, Agent, or Firm*—Jerry A. Miller

[57] ABSTRACT

An improved liquid applicator especially suitable for applying suntan lotion or the like to the skin includes a bottle for holding suntan lotion with a cap for closing the bottle. The inner surface of the cap is coupled to a shaft having a plurality of applicator pads coupled to its end. The applicator pads are preferrably are made of a synthetic or artificial skin material which are resiliently urged away from the shaft. There is an actuator sleeve surrounding a portion of the shaft and coupled to the applicator pads which resiliently urge the sleeve toward the cap. The end of the sleeve closest to the cap includes a cam which operates in cooperation with a mating surface on the inner side of the cap to allow the actuator sleeve to be locked into a position which urges the applicator pads away from the shaft. The outer side of the cap is preferrably shaped to form a comfortable handle and includes a storage compartment for storage of keys, money and the like at the beach.

6 Claims, 2 Drawing Sheets

LIQUID APPLICATOR ESPECIALLY SUITABLE FOR APPLICATION OF SUNTAN LOTION

CROSS REFERENCE TO RELATED DOCUMENTS

An embodiment of this invention is shown and described in U.S. Patent Office Disclosure Document No. 141622. This Disclosure Document is hereby incorporated by reference as though disclosed fully herein.

BACKGROUND OF THE INVENTION

1. Field of the Invention

This invention relates generally to the field of applicators for applying a liquid to a surface. More particularly, this invention relates to applicators for applying liquids to the skin of animals. The invention is especially well adapted to applying suntan lotion or oil to human skin in hard to reach areas such as the back and provides an applicator pad surface resembling the feel of a human hand. In addition the present invention provides a convenient storage location for keys, money, etc. as part of a suntan lotion applicator arrangement.

2. Background

It is frequently advisable or necessary for a person to apply a liquid such as liquid soap, suntan lotion, creams or medicated liquids to the skin in hard to reach places such as the back. Without the assistance of others, this can be a difficult task. It may be an especially difficult task for the elderly or handicapped who may be unable for comfortably reach even normally accessible places such as legs and feet as well as the back.

The application of suntan oils or sunscreens may also prevent special problems for athletes and other sports participants. In order to properly grip sports equipment such as baseball bats, golf clubs and the like, it is clearly advisable to avoid the presence of such oily substances on the hands. Since many athletes must perform outdoors where the effects of direct sunlight are difficult to avoid, this may present an especially serious problem for them. It is therefore advisable to provide an applicator which largely avoids the mess of application of such liquids.

It is advantageous to provide an applicator with a number of resilient contact surfaces to reduce the frequency of dipping into the liquid being applied. Such an applicator should also provide a soothing feel resembling that of human skin to massage the liquid into the skin. It is also advantageous for such an applicator to include contact surfaces which may be adjusted to various shapes to readily adapt to various body or other surface contours.

Since such applicators will likely find wide use at the beach for application of suntan lotion, the present invention solves the above problems as well as providing a convenient place for storage of keys, money etc. while swimming. Moreover, in use at the beach it is desirable to provide a compact and easily stored and carried applicator which may be readily stored in a beach bag or carried with the ease of traditional suntan lotion containers.

Various elongated applicator configurations have been proposed for use with suntan lotion and the like. Such devices are shown for example in U.S. Pat. Nos. 4,483,636 to Meyer, 4,396,028 to Waggoner, 4,171,171 to Jones, 4,128,350 to Gamache, 4,078,865 to Moser and Des. 246,804 to Kesler. These devices, however, are not as compact and readily portable for use at the beach as the present invention. In addition, these devices require a relatively large reservoir of liquid as part of the applicator in conjunction with a relatively large sponge or other pourous pad. As such, the pad is subject to becoming oversaturated with liquid resulting in a more than desirable quantity of liquid being deposited on the skin. Furthermore, some of these devices have no apparent provision for closure to prevent leakage or drying out of the liquid on the pad.

Such devices as understood are also deficient in providing an applicator pad surface which is suitable for applying such liquids in a manner conducive to massage of the liquid into the skin. That is, when applying suntan lotion or the like to readily accessible areas of the skin, it is not normally applied with a sponge surface or the like. Rather, it is generally applied with the human hand and massaged into the skin.

The present invention overcomes these and other shortcomings in the art with a novel applicator using preferrably an artificial skin as an applicator pad.

SUMMARY OF THE INVENTION

It is an object of the present invention to provide an improved liquid applicator.

It is another object of the present invention to provide a liquid applicator which is especially adapted to enhance the user's ability to apply liquid to hard to reach places.

It is another object of the present invention to provide a liquid applicator with improved pad surfaces for a more desirable deposition of suntan lotion or the like.

It is another object of the present invention to provide a liquid applicator having a plurality of pad surfaces.

It is another object of the present invention to provide an improved liquid applicator having an applicator whose shape is adjustable.

It is also an object of the present invention to provide a liquid applicator having an applicator pad which simulates human skin.

It is a further object of the present invention to provide a suntan lotion dispenser having a storage compartment for such personal articles as keys and money.

In one embodiment of the present invention an improved liquid applicator for applying liquid to the skin includes a handle and an applicator pad coupled to the handle. The applicator pad includes a first surface of skin-like material. Preferrably a plurality of applicator pads are used and are situated circumferentially about a shaft coupled to the handle. An actuator sleeve surrounds the shaft and is used to deform the applicator pads into an ellipsoidal shape having a larger minor axis and therefore smaller eccentricity than that of the normal ellipsoidal shape prior to actuation of the applicator sleeve.

In another embodiment of the present invention, a liquid applicator especially suitable for applying liquids to the skin includes a handle coupled to the first end of a shaft having a length and a first and a second end. An applicator pad is coupled to the shaft adjacent the second end. The applicator pad normally assumes a first shape and is capable of assuming a second shape. An actuator is coupled to the applicator pad to cause the applicator pad to assume its second shape when actuated.

In another embodiment of the present invention, an improved bottle for containing a liquid includes a bottle having an opening. A bottle cap suitable for closing the opening includes a storage compartment having a cover for opening and closing the storage compartment.

These and other objects, features, and advantages of the invention will become apparent to those skilled in the art upon consideration of the following detailed description taken in conjunction with the accompanying drawings.

DETAILED DESCRIPTION OF THE INVENTION

Figure 1:
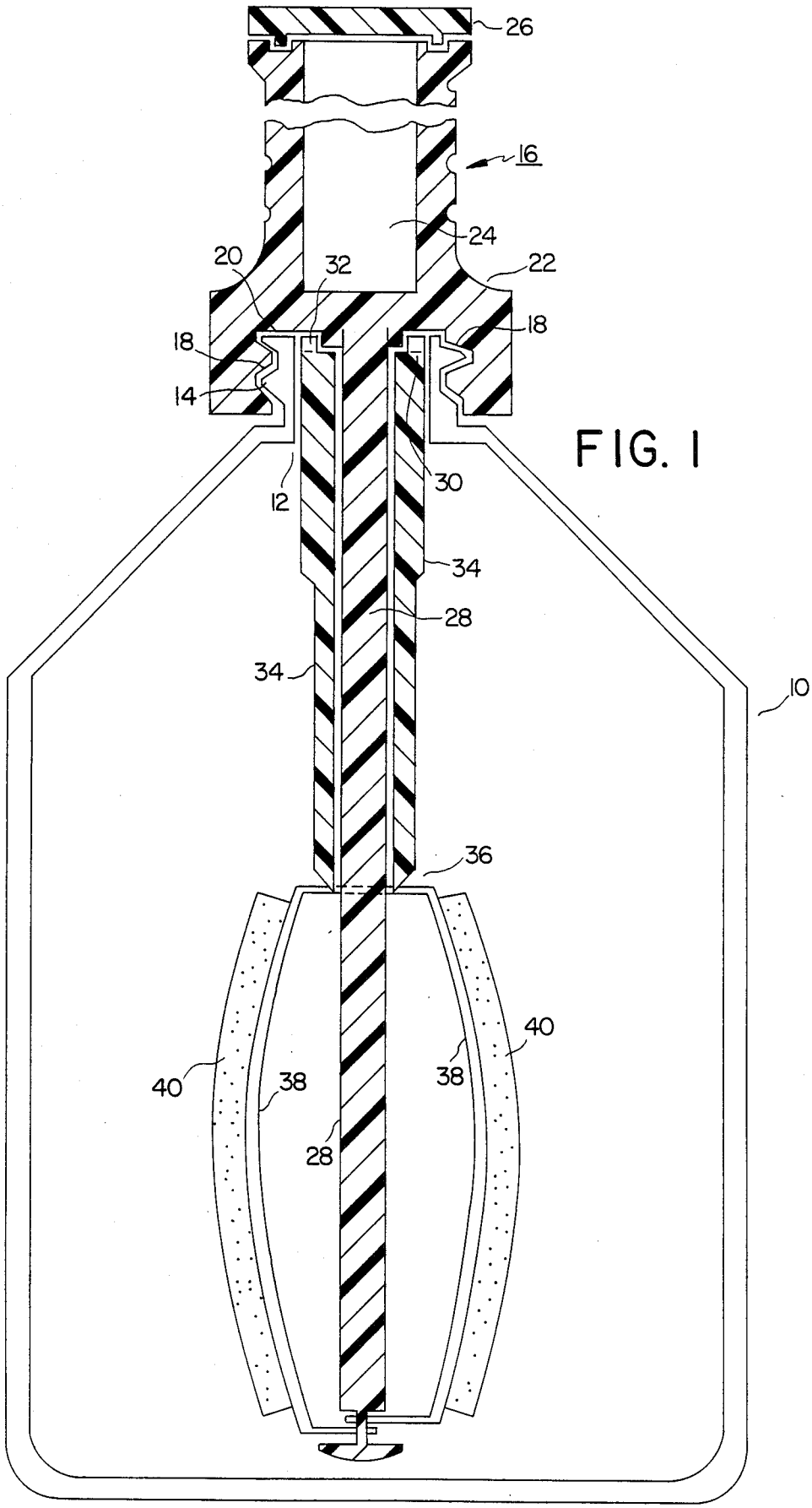
FIG. 1 is a partial cross sectional view of the liquid applicator of the present invention when located inside the bottle.

Turning now to the drawings wherein like reference numerals designate identical or corresponding parts throughout the several views, and more particularly to FIG. 1 thereof, a cross sectional view of the bottle/applicator assembly of the present invention is shown. A bottle 10 which is preferrably made of plastic includes an opening designated generally as 12 which preferrably includes a plurality of male threads 14 on the exterior thereof in a conventional manner. A cap portion, designated generally as 16 includes female threads 18 suitable for engaging the male threads 14 in a known manner to effect opening and closing of the bottle. A cap seal 20 may be used to assure a leak resistant seal when the bottle is closed.

The cap portion 16 may include an extended handle 22 which may assume various configurations conducive to ease of manipulation by the human hand. The handle 22 may include texturing for grip enhancement and decorative purposes as will be appreciated by those skilled in the art. In one embodiment of the present invention, the handle 22 may include a hollow central portion 24 which may be used as a storage compartment for keys, money, coins and the like when the bottle is taken to the beach where it is desirable to conceal such items while swimming, since swimming clothing frequently does not include pockets. In the embodiment including a storage compartment 24, the top portion of handle 22 preferrably includes an opening to provide access to the storage compartment. A cap 26 is used to open and close the storage compartment 24 and may assume various known configurations such as a rubber snap-closure type cap. Those skilled in the art will recognize numerous variations for such a handle assembly.

The inner surface of cap 16 is attached to an integral shaft 28 extending downward into the bottle 10. In the preferred embodiment, shaft 28 and cap 16 are molded as a single part preferrably of high density polyethylene but this is, of course, not to be limiting. This shaft, in an alternative embodiment, may be adapted to be telescoping to increase its length if desired. Those skilled in the art will appreciate the advantages which would be provided by such a feature and will readily recognize various ways to implement the same. The inner surface of cap 16 also includes one or more cam bearing surfaces extending downward toward the bottom of the bottle. These cam surfaces are designated 30 and are more clearly understood after consideration of FIG. 3. These cam surfaces 30 are adapted and shaped to suitably mate with a cam portion 32 (shown more clearly in FIG. 3) situated on the end of an actuator sleeve 34. Actuator sleeve 34 includes a circular bore down its center and is situated about shaft 28. The bore of sleeve 34 is appropriately dimensioned to allow it to slide up and down as well as rotate about the surface of shaft 28 which preferrably has a square cross-section. Of course, the shapes of the shaft and the bore may be modified without departing from the spirit of the present invention.

A lower end 36 of actuator sleeve 34, in the preferred embodiment, abutts a support member 38 for applicator pads 40. Support member 38 is made of a resilient plastic or nylon in the preferred embodiment and is somewhat X shaped. The center of the X has an aperture appropriately dimensioned for fitting over a narrowed section at the lower end of shaft 28. Each end of support member 38 also includes an aperture for mating with shaft 28 and slidably engaging it. The bottom of shaft 28 may be heat staked after installing support member 38 over the shaft 28 to effect assembly of the applicator assembly in an inexpensive manner. Of course, this assembly technique is not to be limiting as many variations are possible including riviting, screwing as well as various adhesive processes known in the art.

Figure 2:
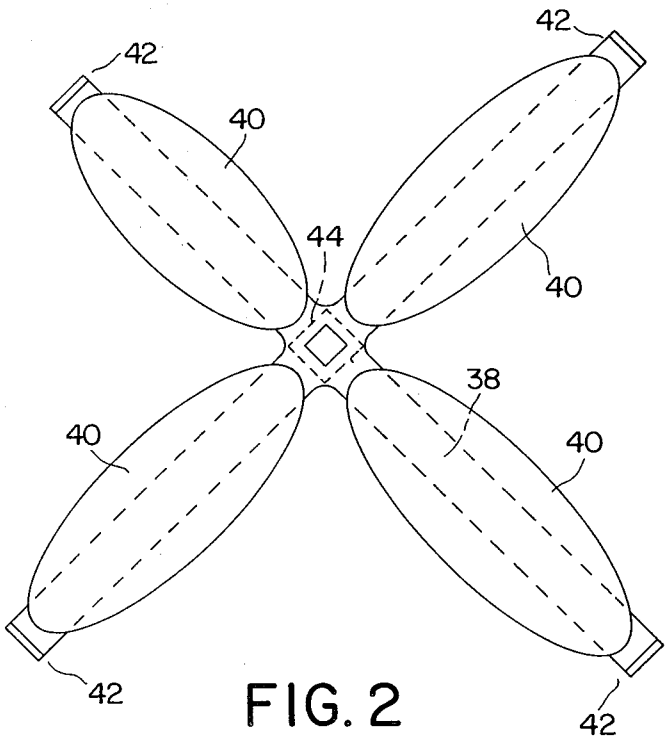
FIG. 2 is a top view of the applicator pad assembly of the present invention.

Turning now to FIG. 2, a disassembled view of the applicator pad assembly is shown. The X shaped support member preferably made of a flexible polyethylene (in the preferred embodiment, a 0.01 inch thickness of high density polyethylene) and includes four heat bends of approximately 90 degrees at each of the four ends 42 of the four legs. Each of the four legs of the support member 38 is preferrably distributed at equal 90 degree increments about the center and may be slightly different in length so that a symmetrical and uniform size and shape for the applicator pad assembly is attained when assembled on shaft 28. Of course, more or fewer legs may be used and they are preferrably equally distributed about the center but this is not to be limiting. The bent portion near ends 42 each include a hole adapted to pass shaft 28. Preferrably, the holes near ends 42 are square to engage the square cross section of shaft 28 to prevent rotation of the applicator pad assembly about shaft 28 while allowing sliding motion along the length of the shaft. The support member 38 may also include slight bends or creases near the central aperture designated as 44 to allow the support member to properly bend when assembled to achieve the desired elliploidal or spherical shape.

A plurality of applicator pads 40 are coupled to each of the legs of support member 38. Applicator pads 40 are preferrably made of a material which simulates the charactistics of skin. An exemplary materal is marketed under the trade name Synthaderm (TM of Durma-Lock Medical Corp., Englewood, Colo.) and is widely available for use in medical applications. Synthaderm (TM) is a modified polyurathane sponge having hydrophilic surface to attract liquids. Such a material is advantageous in that it has a skin-like feel and greatly reduces dripping of liquids. While Synthaderm (TM) is the preferred material, other suitable materials are commercially available which have similar properties such as Poron (TM of Rogers Corp., Rogers, Conn.) may be suitable in many applications or as substitutes for Synthaderm (TM). The applicator pads may be adhesively attached to the support member 38.

In another alternative embodiment, alternative applicator pads may be utilized. Such alternatives as foam or sponge rubber or leather or synthetic leathers may prove suitable for many purposes. Preferrably, the thickness of the pads is kept small to reduce the quantity of liquid to be absorbed so that drip and mess is avoided. In the preferred embodiment, a 0.06 inch thickness of Synthaderm (TM) is preferred.

When the applicator pad is assembled to the shaft, it is preferable for there to be a slight interference fit with the opening 12 of the bottle 10. This allows the bottle opening to remove excess liquid from the pads when they are removed from the bottle so that a more desirable amount of liquid is deposited on the pads and therefore the skin.

The sizes of the various parts aforementioned should preferrably be dimensioned appropriately to cause actuator sleeve 34 to normally be urged toward the cap 16 by the springing action of support member 38. Also, the actuator pad assembly should normally bulge outward slightly in an approximately ellipsoidal shape similar to that of a mixing beater. Preferrably the shaft assembly is approximately 5 to 6 inches long with the handle having length of approximately 3 to 4 inches. This gives an overall length of the applicator of approximately 8 to 10 inches. This provides adequate length for most people to be able to effectively apply lotion to any part of the body. Of course, these dimensions are not to be limiting as other dimensions and pad configurations may prove advantageous in various situations.

Once the applicator assembly has been removed from the bottle, it is desirable to provide a fatter applicator pad assembly with which to more effectively apply the liquid. This is effected in the present invention by rotating actuator sleeve 34 either clockwise or counterclockwise approximately 90 degrees while holding cap portion 16 from rotating so that the cam 32 is forced away from handle 16 and comes to rest on the lowermost portion of cam surface 30. At this point, friction secures or locks the actuator sleeve in a position which effectively reduces the major axis of the ellipsoidally shaped applicator pad assembly. This, of course, effectively reduces the eccentricity of the ellipsoidal applicator pad assembly so that it is closer to spherical than it is when the actuator sleeve 34 is retracted to its normal position for insertion or removal from the bottle 10. Those skilled in the art will recognize that the present cam configuration may be modified or replaced with other suitable structures for effecting a change in the applicator pad assembly shape.

Figure 3:
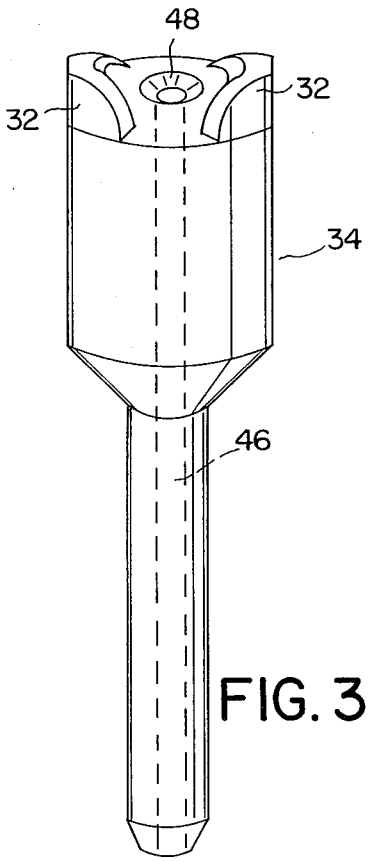
FIG. 3 is a more detailed view of the actuator sleeve of the present invention.

Turning now to FIG. 3, a more detailed view of the actuator sleeve 34 and its associated cams 32 are shown. The circular bore 46 is shown in broken lines. Preferrably, the upper portion of the bore 46 includes an outward taper 48 in a funnel-like configuration to facilitate ease of assembly. The cam elements 32 are shown to be extending outward from the upper surface of the actuator sleeve forming a pair of somewhat half-moon shaped semicircular walls, the top of which meet the cam surfaces 30 of the cap 16 when the actuator sleeve 34 is actuated. When not actuated, the cams 32 rest between the cam surfaces 30 of the cap 16. The cam surfaces 30 of the cap 16, it will be understood, are similarly semicircular walls which mate with the cams 32 in the normal unactuated position and rest on top of each other in the actuated position. When the camming action is effected, the cams 32 operate in conjunction with the cam surfaces 30 in a somewhat conventional manner to utilize the mechanical advantage typical of a wedge. In the preferred embodiment, the actuator sleeve is molded of high density polyethylene. When assembled, the shaft 28 acts as a bearing for both linear and rotational movement of the actuator sleeve 34.

In use, the present applicator advantageously applies an ample but not over abundant amount of suntan oil or other liquid while simultaneously providing the feel of human skin. Removal of the applicator from the bottle 10 produces a wiping action which removes excess liquid from the applicator pads. When one pad 40 has expanded its supply of liquid, it may be replaced by simple rotation of the handle 22 so that the adjacent pad is used. When more liquid is required, the actuator sleeve 34 is simply rotated about shaft 28 to urge the cam surfaces 30 in between the cams 32 so that the applicator may be readily reinserted into bottle 10. After removal of the applicator from the bottle, a simple rotation of the actuator sleeve 34 relative to handle 16 expands the ellipsoidal applicator pad assembly into its operative position.

Those skilled in the art will recognize many variations which are possible within the bounds of the present invention. For example, many variations of the cam assembly may be devised or even replaced with other types of locking assemblies. Also, with further modification to the cam assemblies a continuously variable deformation of the applicator pad assembly may be effected. Or alternatively, a plurality of deformations may be made selectable.

Those skilled in the art will also realize that other materials may be used for the applicator pads themselves depending upon the desired result. The number, size, shape and thickness of the applicator pads 40 and support member 38 may also be widely varied to achieve a wide variety of applicator characteristics. Also, the thickness and resilient properties of the support member 38 may be adjusted to achieve a variety of desired goals.

For the preferred use of application of suntan lotion or oil, it is believed that the additional 8 to 10 inches of reach provided by the present embodiment is adequate for the vast majority of beach-goers. Other uses may, of course, dictate longer or shorter shafts or even embodiments utilizing telescoping or otherwise extensible shafts or handles. Such embodiments are part of this invention.

In summary, an improved liquid applicator is disclosed which meets each of the above objectives. The novel design achieves these goals with a very limited number of inexpensive parts and lends itself to simple and rapid assembly.

Thus, it is apparent that in accordance with the present invention, an apparatus that fully satisfies the aims, advantages and objectives is set forth above. While the invention has been described in conjunction with specific embodiments, it is evident that many alterations, varations and modifications will become apparent to those skilled in the art in light of the foregoing description. Accordingly, it is intended that the present invention embrace all such alternatives, modifications and variations as fall within the spirit and broad scope of the appended claims.

What is claimed as new and desired to be secured by Letters Patent of the United States is:

1. An improved liquid container and applicator, comprising in combination:

a bottle for storing said liquid, said bottle including an opening;

a bottle cap adapted for closure of said opening, said bottle cap including an inner and an outer surface and having a cam engaging portion adjacent said inner surface;

a shaft having first and second ends with said first end coupled to said inner surface;

a liquid applicator pad assembly including an absorbent applicator pad means coupled to said second end of said shaft;

a sleeve situated about said shaft between said bottle cap and said absorbent liquid applicator pad, said sleeve including a cam for engaging said cam engaging portion so that said sleeve may be locked into a position which alters the shape of said liquid applicator pad assembly when said cam and said cam engaging portion are engaged;

a handle coupled adjacent said outer surface of said bottle cap;

said liquid applicator pad assembly further including an approximately X-shaped resilient support member having four legs with four ends and a central area attached to said second end of said shaft, each of said ends including an aperture having said shaft passing therethrough so that said liquid applicator pad assembly assumes an approximately ellipsoidal shape, and wherein said ellipsoidal shape is altered to produce an altered ellipsoidal shape when said cam and cam engaging portions are engaged; and said pad applicator pad means including four pad members, one attached to each of said legs.

2. The apparatus of claim 1, wherein said ellipsoidal shape has eccentricity and wherein sliding said sleeve away from said handle causes a reduction of the eccentricity of said approximately ellipsoidal shape as said altered ellipsoidal shape.

3. The apparatus of claim 1, wherein said opening of said bottle is approximately circular with a diameter, and wherein said ellipsoidal shape has a minor axis which is slightly larger than said diameter so that a wiping action is effected when said applicator pad assembly is removed from said bottle, excess liquid is wiped from said pads.

4. The apparatus of claim 1, further comprising means for adjusting the overall length of said applicator.

5. The apparatus of claim 1, further comprising a storage compartment situated within said handle.

6. The apparatus of claim 1, wherein:

said ellipsoidal shape has eccentricity and wherein sliding said sleeve away from said handle causes a reduction of the eccentricity of said approximately ellipsoidal shape to form said altered ellipsoidal shape;

and wherein said opening of said bottle is approximately circular with a diameter;

and wherein said ellipsoidal shape has a minor axis which is slightly larger than said diameter so that a wiping action is effected when said applicator pad assembly is removed from said bottle, excess liquid is wiped from said pads;

and further comprising means for adjusting the overall length of said applicator; and a storage compartment situated within said handle.

* * * * *